US011104562B2

(12) United States Patent
Liu et al.

(10) Patent No.: US 11,104,562 B2
(45) Date of Patent: Aug. 31, 2021

(54) AUTOMATIC ANTI-ROLL SYSTEM AND METHOD FOR MOBILE ELEVATOR UNDER VARIOUS WORKING CONDITIONS

(71) Applicant: JIANGSU UNIVERSITY, Jiangsu (CN)

(72) Inventors: Jizhan Liu, Jiangsu (CN); Shijie Jiang, Jiangsu (CN); Nan Li, Jiangsu (CN)

(73) Assignee: JIANGSU UNIVERSITY

( * ) Notice: Subject to any disclaimer, the term of this patent is extended or adjusted under 35 U.S.C. 154(b) by 165 days.

(21) Appl. No.: 16/069,091

(22) PCT Filed: Oct. 30, 2017

(86) PCT No.: PCT/CN2017/108230

§ 371 (c)(1),
(2) Date: Jul. 10, 2018

(87) PCT Pub. No.: WO2018/171193

PCT Pub. Date: Sep. 27, 2018

(65) Prior Publication Data

US 2021/0206611 A1 Jul. 8, 2021

(30) Foreign Application Priority Data

Mar. 23, 2017 (CN) ..... 201710178625.0

(51) Int. Cl.
*B66F 11/00* (2006.01)
*B66F 17/00* (2006.01)
*B66F 11/04* (2006.01)

(52) U.S. Cl.
CPC ..... *B66F 17/006* (2013.01); *B66F 11/042* (2013.01)

(58) Field of Classification Search
CPC ..... B66F 11/04; B66F 17/006; B66F 11/00
See application file for complete search history.

(56) References Cited

U.S. PATENT DOCUMENTS 4,390,080 A * 6/1983 Bushnell, Jr. ..... E04G 1/22 182/115
6,405,114 B1 * 6/2002 Priestley ..... B66F 17/006 701/50

(Continued)

FOREIGN PATENT DOCUMENTS

CN 202717560 2/2013
CN 103539045 1/2014

(Continued)

OTHER PUBLICATIONS

International Preliminary Report on Patentability issued in PCT/CN2017/108230, dated Sep. 24, 2019, 6 pages.

(Continued)

*Primary Examiner* — Alvin C Chin-Shue
(74) *Attorney, Agent, or Firm* — Hayes Soloway P.C.

(57) ABSTRACT

Disclosed is an automatic anti-roll system and method for mobile elevator under various working conditions, related to the field of vehicle equipment. The automatic anti-roll system includes a control system, a sensing module, a driving anti-roll module, an air-operation anti-roll module and a small movement anti-roll module. The automatic response to the different manual operations to the mobile elevator is combined with automatic decision based on state sensing of the mobile elevator to realize the automatic judgment and anti-roll control for different working conditions. As a result, the active-passive combined anti-roll control can be realized for various working conditions in various complicated environments such as driving, aerial operations, and small movement. The anti-roll system has a simple structure and can be operated easily. All the advantages make this system and method meet the practical requirements of anti-roll protection for all working conditions of the mobile elevator.

5 Claims, 3 Drawing Sheets

(56) References Cited

U.S. PATENT DOCUMENTS

| | | | | |
|---|---|---|---|---|
| 2003/0173151 | A1 | 9/2003 | Bodtke et al. | 182/18 |
| 2013/0209203 | A1* | 8/2013 | Rafols | B66F 9/0755 414/279 |
| 2014/0246257 | A1* | 9/2014 | Jacobsen | B62D 55/0655 180/14.2 |
| 2017/0081162 | A1* | 3/2017 | Ahern | B62D 5/046 |
| 2020/0139804 | A1* | 5/2020 | Holmes | B66F 11/046 |

FOREIGN PATENT DOCUMENTS

| | | |
|---|---|---|
| CN | 105060200 | 11/2015 |
| CN | 206033152 | 3/2017 |
| CN | 106865459 | 6/2017 |

OTHER PUBLICATIONS

International Search Report and Written Opinion issued in PCT/CN2017/108230, dated Jan. 29, 2018, with English translation, 18 pages.

* cited by examiner

AUTOMATIC ANTI-ROLL SYSTEM AND METHOD FOR MOBILE ELEVATOR UNDER VARIOUS WORKING CONDITIONS

TECHNICAL FIELD

The invention relates to the field of vehicle equipment, in particular to an automatic anti-roll system and method for mobile elevator under various working conditions.

BACKGROUND OF THE INVENTION

Mobile elevators have a wide range of applications in production and daily life, but in agriculture and engineering, mobile elevators are often applied on slopes or non-flat complex ground conditions. Therefore, the anti-roll ability becomes the key to ensure the safety of mobile elevators and meet a wide range of applications.

In the working process of the mobile elevators, there are a variety of working conditions such as running, air operation, and small movement at working positions, and the status of mobile elevators varies greatly in different working conditions. However, the present anti-roll methods of mobile elevators rely on releasing supporting feet to stabilize the machine body, which only has a static anti-roll function in air operation condition. Therefore, it cannot meet the need of anti-roll protection in running, small-scale movement at working positions and the frequent switching among various working conditions. which brings great inconvenience to lifting operations.

SUMMARY OF THE INVENTION

The invention provides an automatic anti-roll system and method for mobile elevator under various working conditions. The invention meets the need for automatic anti-roll of mobile elevators in various operating conditions such as running, air operation, and small movement at working positions.

In order to solve the above technical problems, the specific technical scheme adopted by the invention is as follows:

An automatic anti-roll system for mobile elevator under various working conditions consists of the following components: control system (8), sensing module (7), driving anti-roll module (9), air-operation anti-roll module (10) and small movement anti-roll module (11).

The driving anti-roll module (9) consists of braking relay (12), deceleration alarm lamp (13), deceleration alarm relay (14), brake alarm lamp (15), chassis brake (16) and anti-roll mechanism. Both ends of control coil of the braking relay (12) are connected into the I/O ports of the control system (8), the brake alarm lamp (15) and the chassis brake (16) are both connected to a same set of normally open contacts of the brake relay (12). The chassis controller (2) is connected to a set of normally closed contacts of the brake relay (12). The chassis (1) is braked by a chassis brake (16). Both ends of control coil of the deceleration alarm relay (14) are connected into the I/O ports of the control system (8), and the control deceleration alarm lamp (13) is connected to a set of normally closed contacts of the deceleration alarm relay (14).

The air-operation anti-roll module (10) consists of reset protection relay (19), lifting protection relay (20), lifting alarm lamp (21), lifting brake (22) and anti-roll mechanism. Both ends of control coil of the lifting protection relay (20) are connected into the I/O ports of the control system (8), the lifting alarm lamp (21) and the lifting brake (22) are connected to a same set of normally open contacts of the lifting protection relay (20), and the lifting controller (5) is connected to a set of normally closed contacts of the lifting protection relay (20). The lifting mechanism (6) is braked by the lifting brake (22). The reset protection relay (19) is connected to the balance relay (17) to be interlocked. Both ends of control coil of the reset protection relay (19) are connected to the potentiometer of the chassis joystick (3), and the controller of the anti-roll balancer (18) is connected to a set of normally closed contacts of the reset protection relay (19).

The small movement anti-roll module (11) consists of time switch (23), down limit switch (24) and anti-roll balancer (18). The down limit switch (24) is mounted on the lifting mechanism (6) and the down limit switch (24) is triggered when the lifting mechanism (6) goes down to the lowest position. A set of normally closed contacts of the down limit switch (24) is connected between the time switch (23) and the potentiometer of the chassis joystick (3). Both ends of the time switch (23) are connected to the controller of the anti-roll balancer (18).

The control method of an automatic anti-roll system for mobile elevator under various working conditions, is characterized by the fact as follow. The automatic judgment and anti-roll control for different working conditions are realized by both automatic response of the control system (8) to the different manual operations to the mobile elevator, and automatic decision based on state sensing of the mobile elevator by the sensing module (7).

The method of an automatic anti-roll system for mobile elevator under various working conditions, is characterized by the judgement and anti-roll control for the different working condition as follows:

Type 1 is the anti-roll control under the driving condition:

When the down limit switch (24) is triggered, the operation of pushing the chassis joystick (3) means that the mobile elevator is under the driving condition with the lowest position of the lifting mechanism (6). Under this condition, the high-level signal, caused by pushing the chassis joystick (3), makes the driving protection relay (25) disconnect the lifting controller (5). As a result, the lifting switch (4) loses its function while the chassis (1) is running, to avoid the danger caused by misoperation or accidental touch of the lifting switch (4).

The control system (8) performs the lateral load transfer rate (R) calculation according to parameters of the mobile elevator detected by the sensing module (7) in real time. If the lateral load transfer rate (R) exceeds the roll-over alarm threshold [$R_1$], indicating that the mobile elevator has a slight risk of roll-over due to slope, speed and other factors, the deceleration alarm relay (14) in the driving anti-roll module (9) is automatically triggered. At the same time, the deceleration alarm lamp (13) is also triggered, which warns the operator to reduce the running speed of the chassis (1) with the chassis joystick (3) and observe the driving conditions, so as to achieve an active anti-roll response. If the lateral load transfer rate (R) exceeds the rollover risk threshold [$R_2$], indicating that the mobile elevator has a significant risk of roll-over, the brake relay (12) and the balance relay (17) in the driving anti-roll module (9) are both triggered automatically. Then the chassis brake (16) is started up to perform emergency braking on the chassis (1). And at the same time, the anti-roll balancer (18) acts automatically for mechanical anti-roll protection, and the brake alarm lamp (15) is triggered to alarm to warn the operator to shut down the mobile elevator.

Type 2 is air-operation anti-roll control under air operation condition:

The low-level signal issued by the potentiometer after the reset of the chassis joystick (3) recovers the function of the lifting switch (4). After the reset of the chassis joystick (3), the low-level signal sent by the potentiometer deactivates the reset protection relay (19), and the anti-roll balancer (18) acts automatically for mechanical anti-roll protection. At the same time, the balance relay (17) is deactivated by the interlocking relationship between the reset protection relay (19) and the balance relay (17). It realizes a reset locking, providing protection for lifting and air operations.

After the reset locking, the press down of the lifting switch (4) indicates that the mobile elevator is in the lifting condition. The control system (8) performs the lateral load transfer rate (R) calculation according to parameters of the mobile elevator detected by the sensing module (7) in real time during the lifting process. If the lateral load transfer rate (R) exceeds the roll-over alarm threshold [$R_1$], indicating that there is a slight risk of roll-over on the sloping and uneven ground. The lifting protection relay (20) in air-operation anti-roll module (10) are triggered automatically. Then the lifting brake (22) is triggered to perform emergency braking on the lifting mechanism (6), and the lifting alarm lamp (21) is triggered to alarm to warn the operator to stop further lifting.

Type 3 is the small movement anti-roll control of the small movement:

When the down limit switch (24) is not triggered, it indicates that the mobile elevator is in the lifting state. At this time, the pushing of the chassis joystick (3) indicates that the operator wants to perform a small-scale position movement of the mobile elevator to reach a better working position for air operation. The high-level signal, caused by pushing the chassis joystick (3), makes the timing switch (23) in the small movement anti-roll module (11) be triggered. Then the anti-roll balancer (18) is semi-expanded to conduct the mechanical anti-roll protection of the chassis (1) in the small-scale movement. At the same time, the high-level signal, caused by pushing the chassis joystick (3), recovers the function of the balance relay (17) and deactivates the reset protection relay (19) through the interlocking relationship between the reset protection relay (19) and the balance relay (17). As a result, a faster automatic anti-roll response is realized under a small movement of the chassis (1).

The control system (8) performs the lateral load transfer rate (R) calculation according to parameters of the mobile elevator detected by the sensing module (7) in real time during small movement of the chassis (1). If the lateral load transfer rate (R) exceeds the roll-over alarm threshold [$R_1$], indicating that the mobile elevator has a slight risk of roll-over due to slope, speed, shaking of the operator in the air and other factors, the deceleration alarm relay (14) in the driving anti-rollover module (9) is triggered automatically. When the deceleration alarm relay (14) is activated, the deceleration alarm lamp (13) is triggered, which warns the operator to reduce the small movement speed of the chassis (1) with the chassis joystick (3) and observe the ground conditions, so as to achieve an active anti-roll response. If the lateral load transfer rate (R) exceeds the roll-over risk threshold [$R_2$], indicating that the mobile elevator has a significant risk of roll-over, the brake relay (12) and the balance relay (17) in the driving anti-roll module (9) are both triggered automatically. Then the chassis brake (16) is started up to perform emergency braking on the chassis (1), and at the same time, the anti-roll balancer (18) acts automatically for anti-roll protection, and the brake alarm lamp (15) is triggered to warn the operator to alarm to warn the operator to shut down the mobile elevator.

The invention has beneficial effects. In this invention, the automatic response to the different manual operations to the mobile elevator is combined with automatic decision based on state sensing of the mobile elevator to realize the automatic judgment and anti-roll control for different working conditions. As a result, the active-passive combined anti-roll control can be realized for various working conditions in various complicated environments such as driving, aerial operations, and small movement. The anti-roll system has a simple structure and can be operated easily. All the advantages make this system and method meet the practical requirements of anti-roll protection for all working conditions of the mobile elevator.

NOTES: 1. chassis, 2. chassis controller, 3. chassis joystick, 4. lifting switch, 5. lifting controller, 6. lifting mechanism, 7. sensing module, 8. control system, 9. driving anti-roll module, 10. air-operation anti-roll module, 11. small movement anti-roll module, 12. brake relay, 13. deceleration alarm lamp, 14. deceleration alarm relay, 15. brake alarm lamp, 16. chassis brake, 17. balance relay, 18. anti-roll balancer, 19. reset protection relay, 20. lifting protection relay, 21. lifting alarm lamp, 22. lifting brake, 23. time switch, 24. down limit switch, 25. driving protection relay.

The Concrete Implementation Method

Figure 1:
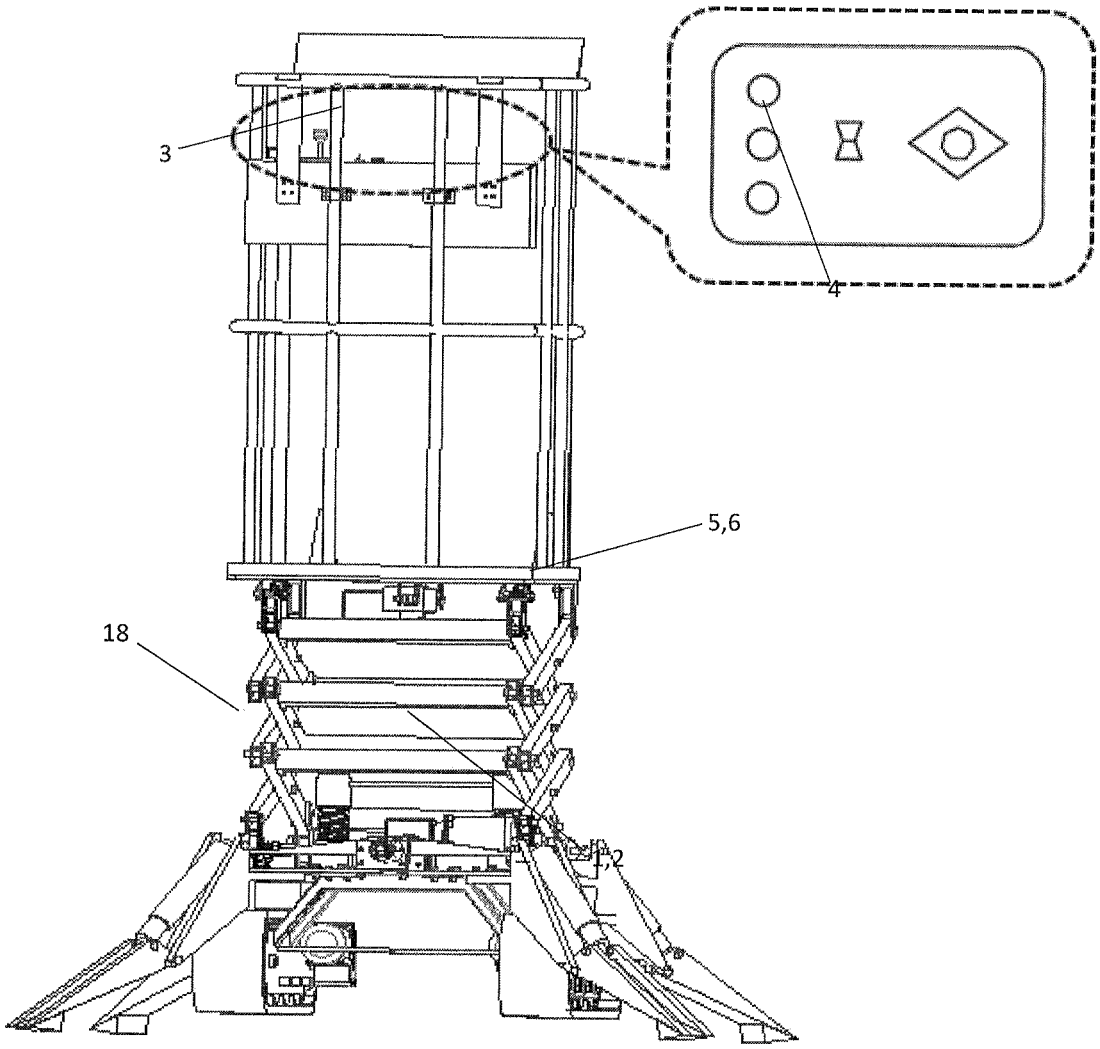
FIG. 1 shows the schematic diagram of the structure of the mobile elevator.

As shown in FIG. 1, the mobile elevator includes a chassis 1, a chassis controller 2, a chassis joystick 3, a lifting switch 4, a lift controller 5, an lifting mechanism 6, and a driving protection relay 25. A potentiometer is installed in the chassis joystick 3, when the chassis joystick 3 is pushed forward-backward or left-right, the potentiometer outputs a high-level signal to realize forward-backward movement or left-right rotation through the chassis controller 2, respectively. The potentiometer outputs the low-level signal when the chassis joystick 3 is released to reset to the center position automatically. The lifting switch 4 controls the lifting of the lifting mechanism 6 through the lifting controller 5. The driving protection relay 25 is connected to the potentiometer of the chassis joystick 3, and the lifting controller 5 is connected to the set of normally closed contacts of the driving protection relay 25. When the chassis joystick 3 is pushed to send a high-level signal to let the chassis 1 running or moving, the high-level signal makes the driving protection relay 25 disconnect the lifting controller 5. As a result, the lifting switch 4 is disabled during the chassis 1 running or movement to avoid danger of misoperation or accidental touch.

Figure 2:
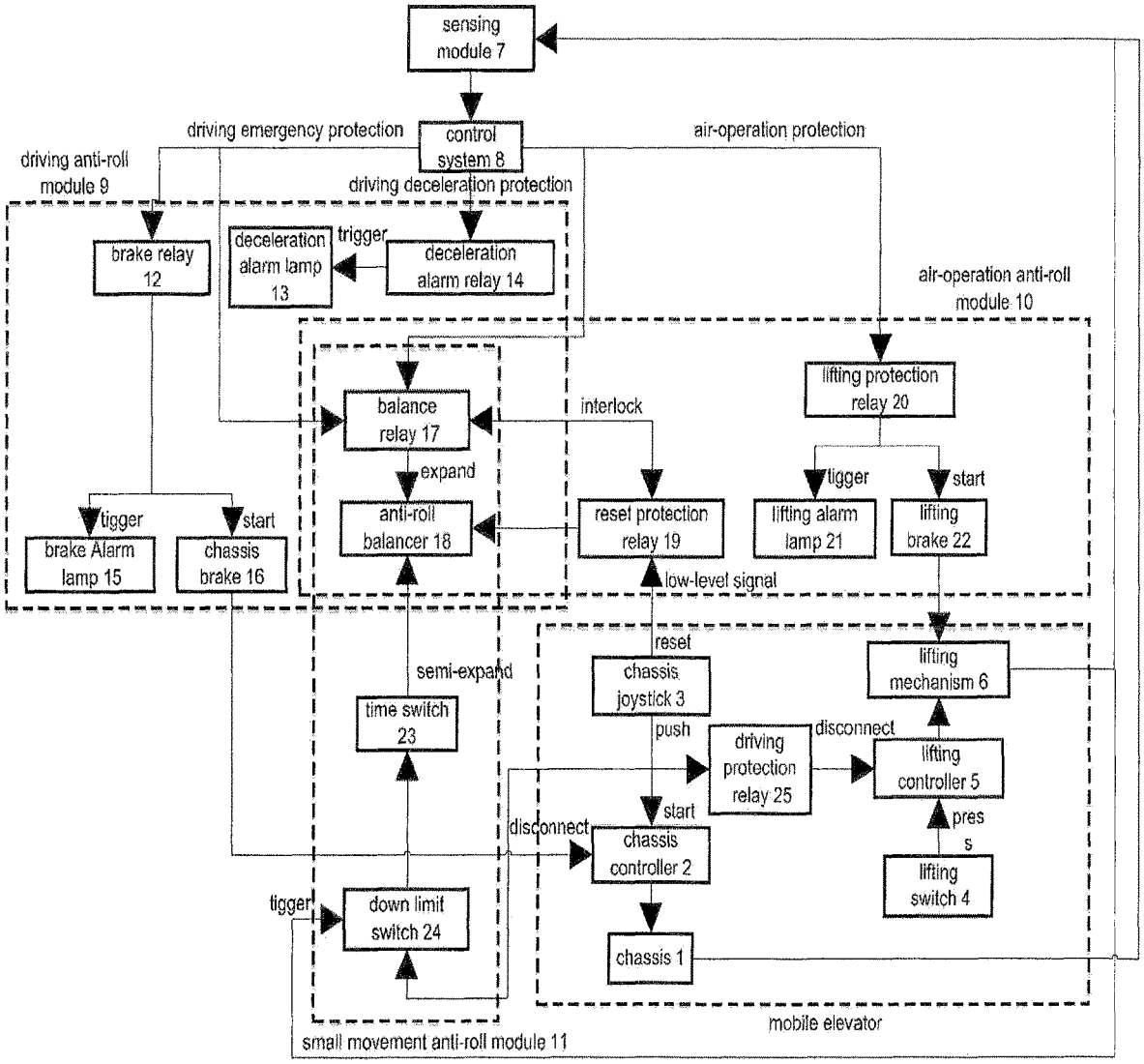
FIG. 2 shows the logic schematic diagram of automatic anti-roll system of the mobile elevator.

As shown in FIG. 2, the anti-roll control system consists of control system 8, sensing module 7, driving anti-roll module 9, air-operation anti-roll module 10 and small movement anti-roll module 11. The sensing module 7 detects the status of the mobile elevator and inputs it to the control system 8, and the control system 8 outputs the operation instructions to the driving anti-roll module 9, the air-operation anti-roll module 10 or the small movement anti-roll module 11.

The driving anti-roll module 9 consists of braking relay 12, deceleration alarm lamp 13, deceleration alarm relay 14, brake alarm lamp 15, chassis brake 16 and anti-roll mechanism. Both ends of control coil of the braking relay 12 are connected into the I/O ports of the control system 8, the brake alarm lamp 15 and the chassis brake 16 are both connected to a same set of normally open contacts of the brake relay 12. The chassis controller 2 is connected to a set of normally closed contacts of the brake relay 12. The chassis 1 is braked by a chassis brake 16. Both ends of control coil of the deceleration alarm relay 14 are connected into the I/O ports of the control system 8, and the control deceleration alarm lamp 13 is connected to a set of normally closed contacts of the deceleration alarm relay 14.

The anti-roll mechanism includes a balance relay 17 and an anti-roll balancer 18, both ends of a control coil of the balance relay 17 are connected to the I/O port of the control system 8, and the controller of the anti-roll balancer 18 is connected to a set of normally open contacts of the balance relay 17. The anti-roll balancer 18 is composed of three or more anti-roll arms, and the arms are respectively mounted around the chassis 1.

The air-operation anti-roll module 10 consists of reset protection relay 19, lifting protection relay 20, lifting alarm lamp 21, lifting brake 22 and anti-roll mechanism. Both ends of control coil of the lifting protection relay 20 are connected into the I/O ports of the control system 8, the lifting alarm lamp 21 and the lifting brake 22 are connected to a same set of normally open contacts of the lifting protection relay 20, and the lifting controller 5 is connected to a set of normally closed contacts of the lifting protection relay 20. The lifting mechanism 6 is braked by the lifting brake 22. The reset protection relay 19 is connected to the balance relay 17 to be interlocked. Both ends of control coil of the reset protection relay 19 are connected to the potentiometer of the chassis joystick 3, and the controller of the anti-roll balancer 18 is connected to a set of normally closed contacts of the reset protection relay 19.

The small movement anti-roll module 11 consists of time switch 23, down limit switch 24 and anti-roll balancer 18. The down limit switch 24 is mounted on the lifting mechanism 6 and the down limit switch 24 is triggered when the lifting mechanism 6 goes down to the lowest position. A set of normally closed contacts of the down limit switch 24 is connected between the time switch 23 and the potentiometer of the chassis joystick 3. Both ends of the time switch 23 are connected to the controller of the anti-roll balancer 18.

Figure 3:
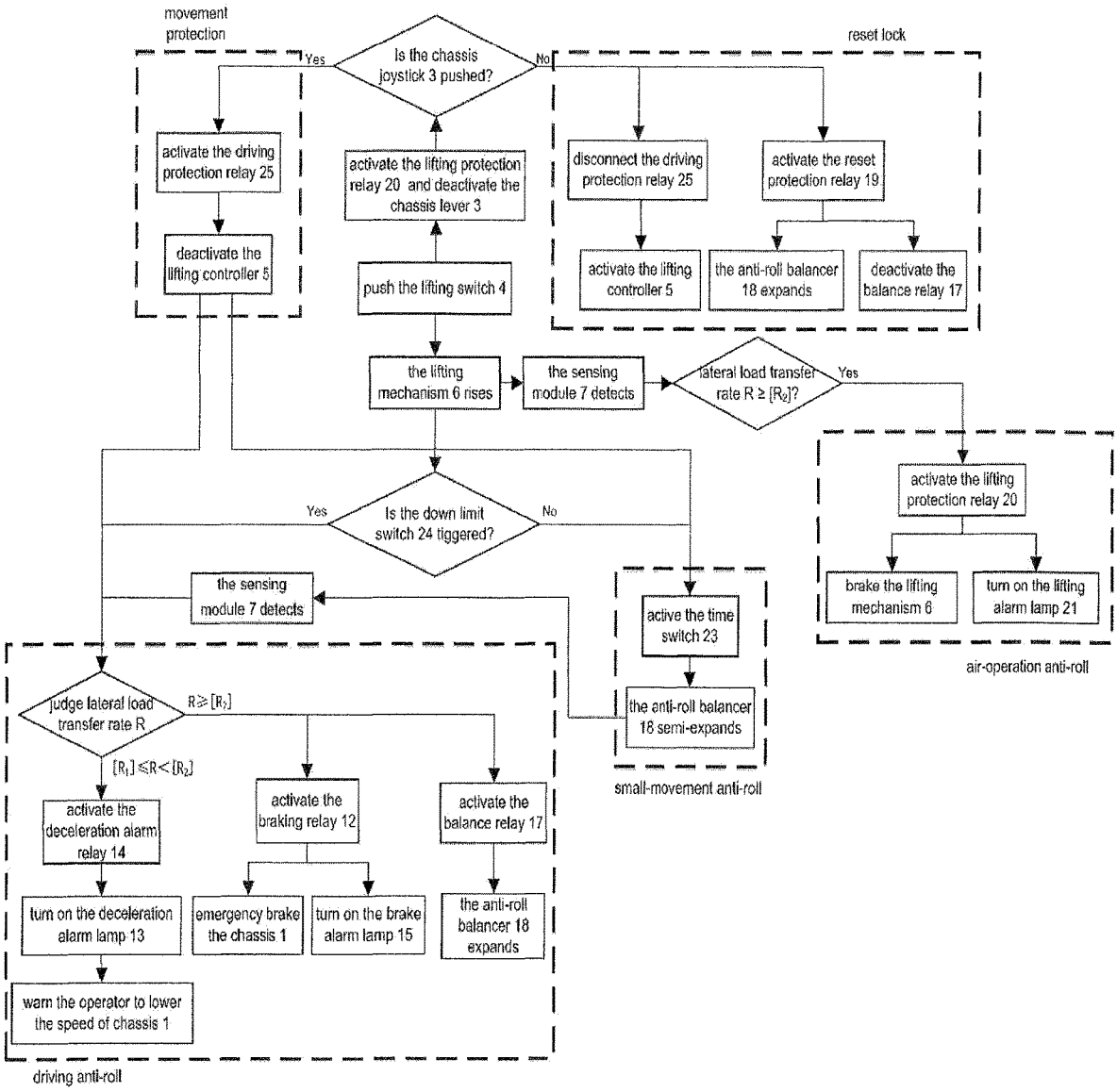
FIG. 3 shows the flow diagram of anti-roll control of the mobile elevator.

As shown in FIG. 3, The control method of an automatic anti-roll system for mobile elevator under various working conditions, is characterized by the fact as follow. The automatic judgment and anti-roll control for different working conditions are realized by both automatic response of the control system (8) to the different manual operations to the mobile elevator, and automatic decision based on state sensing of the mobile elevator by the sensing module 7.

The method of an automatic anti-roll system for mobile elevator under various working conditions, is characterized by the judgement and anti-roll control for the different working condition as follows:

(1) The Anti-Roll Control Under the Driving Condition

When the down limit switch 24 is triggered, the operation of pushing the chassis joystick 3 means that the mobile elevator is under the driving condition with the lowest position of the lifting mechanism 6. Under this condition, the high-level signal, caused by pushing the chassis joystick 3, makes the driving protection relay 25 disconnect the lifting controller 5. As a result, the lifting switch 4 loses its function while the chassis 1 is running, to avoid the danger caused by misoperation or accidental touch of the lifting switch 4.

The control system 8 performs the lateral load transfer rate R calculation according to parameters of the mobile elevator detected by the sensing module 7 in real time. If the lateral load transfer rate R exceeds the roll-over alarm threshold [$R_1$], indicating that the mobile elevator has a slight risk of roll-over due to slope, speed and other factors, the deceleration alarm relay 14 in the driving anti-roll module 9 is automatically triggered. At the same time, the deceleration alarm lamp 13 is also triggered, which warns the operator to reduce the running speed of the chassis 1 with the chassis joystick 3 and observe the driving conditions, so as to achieve an active anti-roll response. If the lateral load transfer rate R exceeds the rollover risk threshold [$R_2$], indicating that the mobile elevator has a significant risk of roll-over, the brake relay 12 and the balance relay 17 in the driving anti-roll module 9 are both triggered automatically. Then the chassis brake 16 is started up to perform emergency braking on the chassis 1. And at the same time, the anti-roll balancer 18 acts automatically for mechanical anti-roll protection, and the brake alarm lamp 15 is triggered to alarm to warn the operator to shut down the mobile elevator.

(2) Air-Operation Anti-Roll Control Under Air Operation Condition:

The low-level signal issued by the potentiometer after the reset of the chassis joystick 3 recovers the function of the lifting switch 4. After the reset of the chassis joystick 3, the low-level signal sent by the potentiometer deactivates the reset protection relay 19, and the anti-roll balancer 18 acts automatically for mechanical anti-roll protection. At the same time, the balance relay 17 is deactivated by the interlocking relationship between the reset protection relay 19 and the balance relay 17. It realizes a reset locking, providing protection for lifting and air operations.

After the reset locking, the press down of the lilting switch 4 indicates that the mobile elevator is in the lifting condition. The control system 8 performs the lateral load transfer rate R calculation according to parameters of the mobile elevator detected by the sensing module 7 in real time during the lifting process. If the lateral load transfer rate R exceeds the roll-over alarm threshold [$R_1$], indicating that there is a slight risk of roll-over on the sloping and uneven ground. The lifting protection relay 20 in air-operation anti-roll module 10 are triggered automatically. Then the lifting brake 22 is triggered to perform emergency braking on the lifting mechanism 6, and the lifting alarm lamp 21 is triggered to alarm to warn the operator to stop further lifting.

(3) The Small Movement Anti-Roll Control of the Small Movement:

When the down limit switch 24 is not triggered, it indicates that the mobile elevator is in the lifting state. At this time, the pushing of the chassis joystick 3 indicates that the operator wants to perform a small-scale position movement of the mobile elevator to reach a better working position for air operation. The high-level signal, caused by pushing the chassis joystick 3, makes the timing switch 23 in the small movement anti-roll module 11 be triggered. Then the anti-roll balancer 18 is semi-expanded to conduct the mechanical anti-roll protection of the chassis 1 in the small-scale movement. At the same time, the high-level signal, caused by pushing the chassis joystick 3, recovers the function of the balance relay 17 and deactivates the reset protection relay 19 through the interlocking relationship between the reset protection relay 19 and the balance relay 17. As a result, a faster automatic anti-roll response is realized under a small movement of the chassis 1.

The control system 8 performs the lateral load transfer rate R calculation according to parameters of the mobile elevator detected by the sensing module 7 in real time during small movement of the chassis 1. If the lateral load transfer rate R exceeds the roll-over alarm threshold [$R_1$], indicating that the mobile elevator has a slight risk of roll-over due to slope, speed, shaking of the operator in the air and other factors, the deceleration alarm relay 14 in the driving anti-rollover module 9 is triggered automatically. When the deceleration alarm relay 14 is activated, the deceleration alarm lamp 13 is triggered, which warns the operator to reduce the small movement speed of the chassis 1 with the chassis joystick 3 and observe the ground conditions, so as to achieve an active anti-roll response. If the lateral load transfer rate R exceeds the roll-over risk threshold [$R_2$], indicating that the mobile elevator has a significant risk of roll-over, the brake relay 12 and the balance relay 17 in the driving anti-roll module 9 are both triggered automatically. Then the chassis brake 16 is started up to perform emergency braking on the chassis 1, and at the same time, the anti-roll balancer 18 acts automatically for anti-roll protection, and the brake alarm lamp 15 is triggered to warn the operator to alarm to warn the operator to shut down the mobile elevator.

The invention claimed is:

1. An automatic anti-roll system for a mobile elevator, comprising, in combination, a control system, a sensing module, a driving anti-roll module, an air-operation anti-roll module and a small movement anti-roll module, wherein the driving anti-roll module comprises a braking relay, a deceleration alarm lamp, a deceleration alarm relay, a brake alarm lamp, a chassis brake of a chassis and an anti-roll mechanism, wherein both ends of a control coil of a braking relay are connected into I/O ports of the control system, both the brake alarm lamp and the chassis brake are both connected to a same set of normally open contacts of the brake relay; wherein a chassis controller is connected to a set of normally closed contacts of the brake relay; and the chassis is braked by the chassis brake;

both ends of control coil of the deceleration alarm relay are connected into the I/O ports of the control system, and, the control deceleration alarm lamp is connected to a set of normally closed contacts of the deceleration alarm relay;

the air-operation anti-roll module comprises a reset protection relay, a lifting protection relay, a lifting alarm lamp, a lifting brake of a lifting mechanism and anti-roll mechanism; wherein both ends of a control coil of the lifting protection relay are connected into the I/O ports of the control system; the lifting alarm lamp and the lifting brake are connected to a same set of normally open contacts of the lifting protection relay; and a lifting controller is connected to a set of normally closed contacts of the lifting protection relay; the lifting mechanism is braked by the lifting brake; the reset protection relay is connected to a balance relay to be interlocked; both ends of control coil of the reset protection relay are connected to a potentiometer of a chassis joystick; and, a controller of the anti-roll balancer is connected to a set of normally closed contacts of the reset protection relay, and the small movement anti-roll module comprises a time switch, a down limit switch and the anti-roll balancer; a down limit switch is mounted on the lifting mechanism and the down limit switch is triggered when the lifting mechanism goes down to its lowest position; a set of normally closed contacts of the down limit switch is connected between a time switch and the potentiometer of the chassis joystick; and both ends of the time switch are connected to the controller of the anti-roll balancer.

2. A control method of the anti-roll system of claim 1, wherein an automatic judgment and anti-roll control for different working conditions are realized by both an automatic response of the control system to different manual operations to the mobile elevator, and an automatic decision based on state sensing of the mobile elevator by the sensing module.

3. The method of claim 2, wherein the judgment and anti-roll control for the different working condition is under driving condition, wherein when the down limit switch is triggered, operation of pushing the chassis joystick indicates that the mobile elevator is under the driving condition with a lowest position of the lifting mechanism; wherein under the driving condition, the high-level signal, caused by pushing the chassis joystick, makes the driving protection relay disconnect the lifting controller, and, as a result, the lifting switch loses its function while the chassis is running, to avoid danger caused by misoperation or accidental touch of the lifting switch; and the control system performs a lateral load transfer rate (R) calculation according to parameters of the mobile elevator detected by the sensing module in real time, wherein if the lateral load transfer rate (R) exceeds a roll-over alarm threshold [Ri], indicating that the mobile elevator has a slight risk of roll-over due to slope, speed and other factors, a deceleration alarm relay in the driving anti-roll module is automatically triggered, and at the same time, a deceleration alarm lamp is also triggered, which warns an operator to reduce a running speed of the chassis with the chassis joystick and observe the driving conditions, so as to achieve an active anti-roll response, and if the lateral load transfer rate (R) exceeds the rollover risk threshold (R2), indicating that the mobile elevator has a significant risk of rollover, the brake relay and the balance relay in the driving anti-roll module are both triggered automatically, wherein the chassis brake is started up to perform emergency braking on the chassis, and at the same time, the anti-roll balancer acts automatically for mechanical anti-roll protection, and the brake alarm lamp is triggered to alarm to warn the operator to shut down the mobile elevator.

4. The method of claim 2, wherein the judgment and anti-roll control in the different working condition is under air operation condition, wherein when a low-level signal issued by the potentiometer after a reset of the chassis joystick recovers a function of the lifting switch, after the reset of the chassis joystick, a low-level signal sent by the potentiometer deactivates the reset protection relay, and the anti-roll balancer acts automatically for mechanical anti-roll protection, and at the same time, the balance relay is deactivated by an interlocking relationship between the reset protection relay and the balance relay, to realizes a reset locking, providing protection for lifting and air operations, and after the reset locking, press down of the lifting switch indicates that the mobile elevator is in a lifting condition, the control system performs a lateral load transfer rate (R) calculation according to parameters of the mobile elevator detected by the sensing module in real time during a lifting process, and if the lateral load transfer rate (R) exceeds a roll-over alarm threshold (Ri), indicating that there is a slight risk of roll-over on the sloping and uneven ground, the lifting protection relay in air-operation anti-roll module are triggered automatically, then the lifting brake is triggered to perform emergency braking on the lifting mechanism, and the lifting alarm lamp is triggered to alarm to warn an operator to stop further lifting.

5. The method of claim 2, wherein the judgment and anti-roll control for the different working conditions is a small movement anti-roll control of the small movement anti-roll module, wherein when the down limit switch is not triggered, thereby indicating that the mobile elevator is in a lifting state, at which time, pushing of the chassis joystick indicates that an operator wants to perform a small-scale position movement of the mobile elevator to reach a better working position for air operation; wherein a high-level signal, caused by pushing the chassis joystick, triggers a timing switch in the small movement anti-roll module, then the anti-roll balancer is semi-expanded to conduct a mechanical anti-roll protection of the chassis in a small-scale movement, and, at the same time, a high-level signal, caused by pushing the chassis joystick, recovers a function of the balance relay and deactivates the reset protection relay through interlocking relationship between the reset protection relay and the balance relay, and, as a result, a faster automatic anti-roll response is realized under a small movement of the chassis, and the control system performs a lateral load transfer rate (R) calculation according to parameters of the mobile elevator detected by the sensing module in real time during small movement of the chassis, and if the lateral load transfer rate (R) exceeds a roll-over alarm threshold (Ri), indicating that the mobile elevator has a slight risk of roll-over due to slope, speed, shaking of an operator, a deceleration alarm relay in the anti-rollover module is triggered automatically, when a deceleration alarm relay is activated, the deceleration alarm lamp is triggered, which warns the operator to reduce a small movement speed of the chassis with the chassis joystick and observe ground conditions, so as to achieve an active anti-roll response, and, if the lateral load transfer rate (R) exceeds a roll-over risk threshold (R2), indicating that the mobile elevator has a significant risk of roll-over, the brake relay and the balance relay in the anti-roll module are both triggered automatically, then the chassis brake is started up to perform emergency braking on the chassis, and at the same time, the anti-roll balancer acts automatically for anti-roll protection, and the brake alarm lamp is triggered to warn the operator to shut down the mobile elevator.

* * * * *